US007661578B2

(12) United States Patent
Li

(10) Patent No.: US 7,661,578 B2
(45) Date of Patent: Feb. 16, 2010

(54) PACKING BOX

(75) Inventor: Ming Li, Guangdong (CN)

(73) Assignees: Preimer Image Technology(China) Ltd., Foshan, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/109,229

(22) Filed: Apr. 24, 2008

(65) Prior Publication Data

US 2009/0134210 A1 May 28, 2009

(30) Foreign Application Priority Data

Nov. 27, 2007 (CN) ..... 2007 1 0202729

(51) Int. Cl.
*B65D 25/04* (2006.01)
*B65D 85/00* (2006.01)

(52) U.S. Cl. ..... 229/120.13; 206/723; 206/784; 229/120.18; 229/120.21

(58) Field of Classification Search ..... 229/120.13, 229/120.18, 120.21; 206/316.2, 722, 723, 206/725, 784
See application file for complete search history.

(56) References Cited

U.S. PATENT DOCUMENTS

| | | | | | |
|---|---|---|---|---|---|
| 1,466,344 | A * | 8/1923 | Sardou | 229/120.17 |
| 2,670,125 | A * | 2/1954 | Frankenstein | 206/784 |
| 3,107,039 | A * | 10/1963 | Painter | 229/120.13 |
| 3,297,228 | A * | 1/1967 | Contratto | 229/120.13 |
| 4,438,848 | A * | 3/1984 | Montealegre et al. | 229/120.21 |
| 5,018,663 | A * | 5/1991 | Corso | 229/117.13 |
| 5,495,983 | A * | 3/1996 | Lelek | 229/120.13 |
| 7,097,043 | B2 * | 8/2006 | Hsu | 229/120.18 |
| 7,172,109 | B2 * | 2/2007 | Kuenstler et al. | 229/120.13 |
| 7,464,855 | B2 * | 12/2008 | Glasgow | 229/120.13 |
| 2005/0061861 | A1 * | 3/2005 | Pennino | 229/120.13 |

* cited by examiner

*Primary Examiner*—Gary E Elkins
(74) *Attorney, Agent, or Firm*—Andrew C. Cheng

(57) ABSTRACT

A packing box includes four walls, a bottom support, a cover and plates. The walls, the bottom support and the cover cooperatively define a space for accommodating items to be packed therein. The bottom support is formed with the walls for supporting the items packed in the space. The cover is configured for closing the packing box. The plates are disposed in the space and are formed by folding a cardboard extension from one or more of the walls. The plates separate the space into compartments.

12 Claims, 3 Drawing Sheets

PACKING BOX

BACKGROUND

1. Technical Field

The present invention relates to a packing structure, and particularly to a packing box for accommodating several components therein.

2. Description of Related Art

Electronic devices generally comprise several attachments which are packaged within a box together with the electronic device. If the electronic device, as well as the attachments, is placed into the box without any partitions, they may become disordered. For dividing the box into several compartments to hold different components of the electronic device, a perforated cushion is employed. However, the cushion and the box are manufactured separately, which is time-consuming.

What is needed, therefore, is a integrally partitioned box able to receive different components.

SUMMARY

Accordingly, a packing box includes a plurality of walls, a bottom support, a cover and a plurality of plates. The walls, the bottom support and the cover define a space for accommodating items to be packed therein. The bottom support is formed with the walls for supporting the items packed in the space. The cover is configured for closing the packing box. The partitions are disposed in the space and are formed by folding a cardboard extension from one or more of the walls. The plates separate the space into compartments.

Other advantages and novel features will be drawn from the following detailed description of at least one embodiment, when considered in conjunction with the attached drawings.

BRIEF DESCRIPTION OF THE DRAWINGS

Many aspects of the present packing box can be better understood with reference to the following drawings. The components in the drawings are not necessarily drawn to scale, the emphasis instead being placed upon clearly illustrating the principles of the present packing box. Moreover, in the drawings, like reference numerals designate corresponding parts throughout the several views.

DETAILED DESCRIPTION OF THE EMBODIMENTS

Embodiments of the present packing box will be described in detail below with reference to the drawings.

Figure 1:
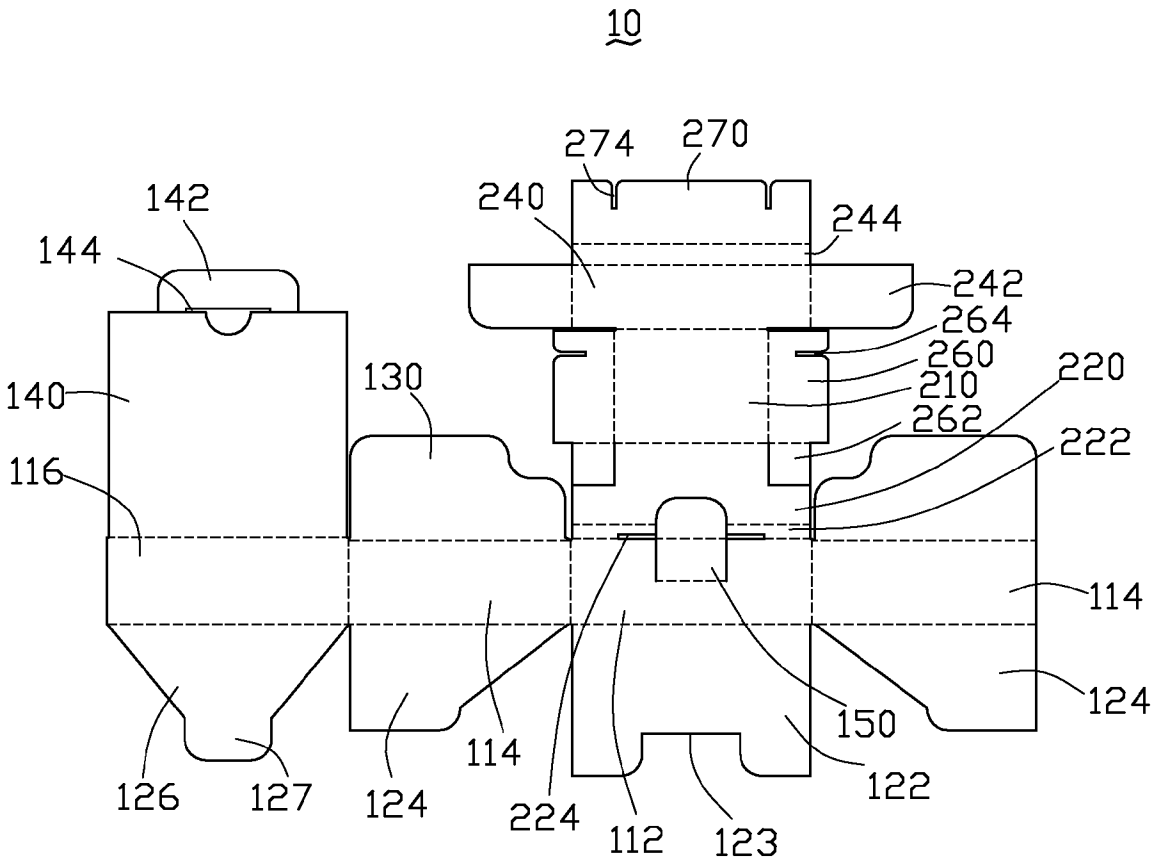
FIG. 1 is an expanded view of a packing box according to an exemplary embodiment.
Figure 2:
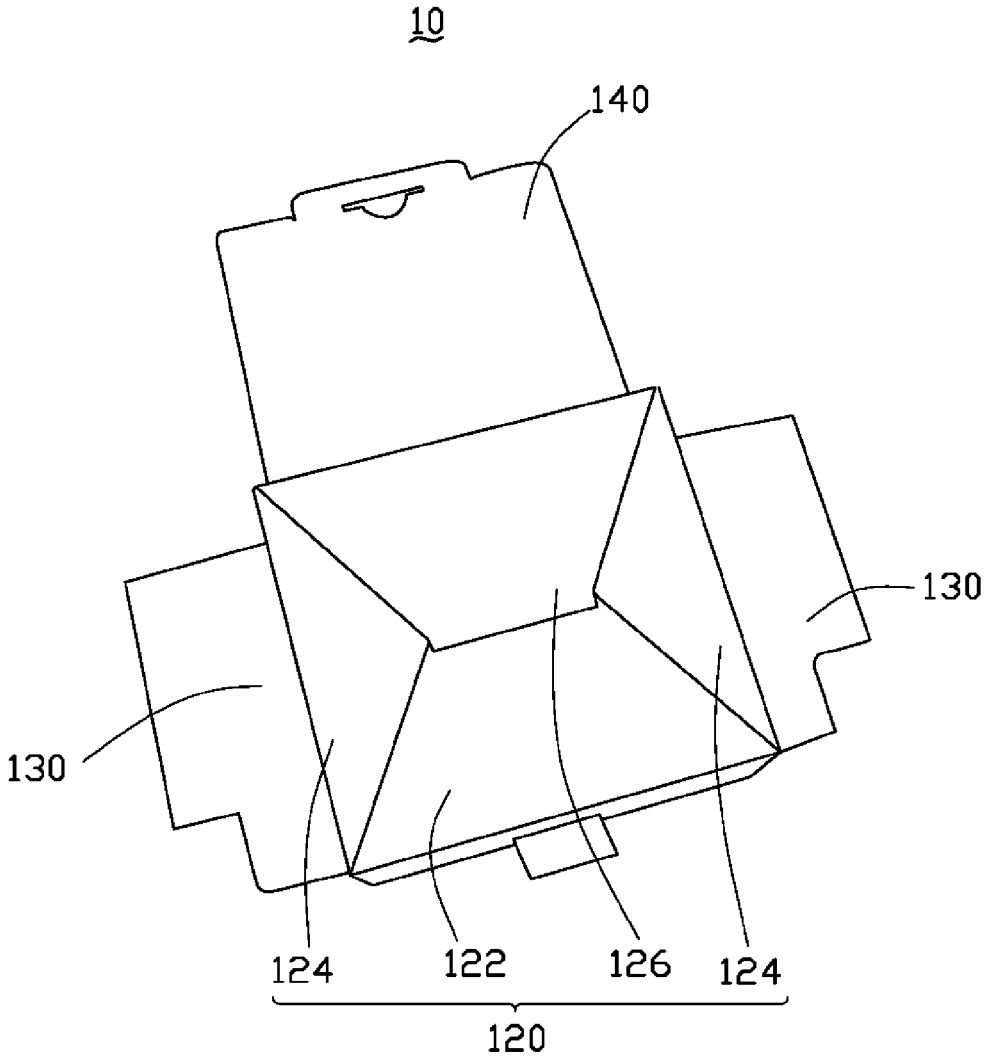
FIG. 2 is an isometric, inverted view of the packing box of FIG. 1, partially folded.
Figure 3:
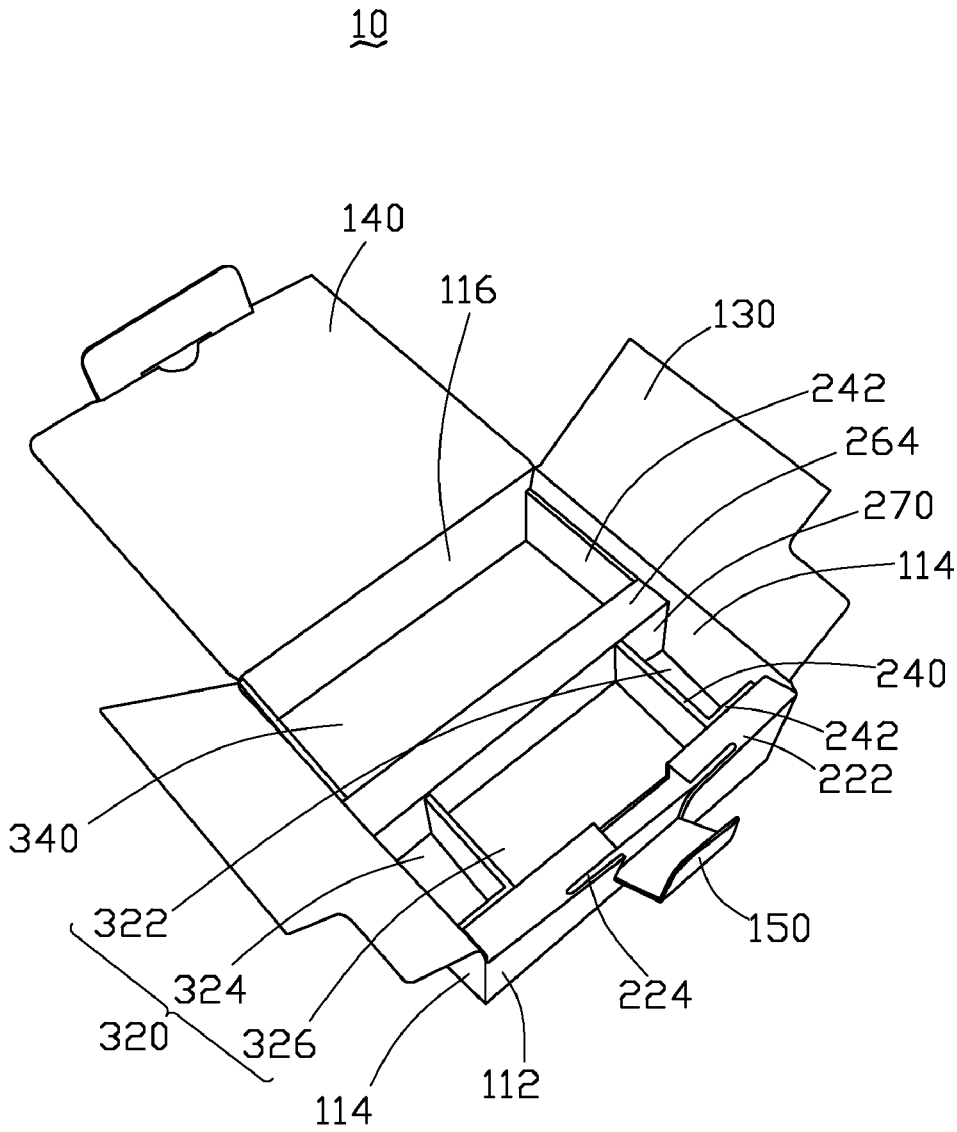
FIG. 3 is an isometric, un-inverted view of the packing box of FIG. 1, partially folded.

Referring to FIGS. 1-3, a packing box 10 according to an exemplary embodiment is illustrated. The packing box 10 is formed by a foldable cardboard sheet cut as shown in FIG. 1 in which dashed lines indicate where the packing box 10 is to be folded.

The packing box 10 comprises walls 112, 114, 116, a bottom support 120, two wings 130, and a cover 140 cooperatively defining a space thereamong for accommodating items to be packed therein. The bottom support 120 is formed with the walls 112, 114, 116 for supporting the items packed in the space. In the exemplary embodiment, the bottom support 120 comprises a first flap 122 extending from the wall 112, two symmetrical second flaps 124 extending from the walls 114, and a third flap 126 extending from the wall 116. The first flap 122 defines a cutout 123 therein. The third flap 126 forms a tail-end 127 which extends into the packing box 10 through the cutout 123 during assembly of the packing box 10.

In assembly as shown in FIG. 2, the flaps 122, 124, 126 are folded inward toward the center portion of the packing box 10 and rotated to overlap each other. In detail, the first flap 122 is folded to be at right angles to the cardboard sheet, then the second flaps 124 are folded at right angles as well then pivoted to contactingly overlap lateral sides of the first flap 122 respectively, then the third flap 126 is folded and rotated to contactingly overlap corresponding sides of the second flaps 124, and the tail-end 127 thereof is extended into the packing box 10 via the cutout 123 of the first flap 122 to abut against an inner surface of the first flap 122. The above-described bottom support 120 is merely an example. In alternative embodiments, bottom supports having any other conventional patterns can be used in the packing box 10.

The wings 130 respectively extend from top edges of the walls 114; the cover 140 and a protrusion 150 are disposed at the two opposite sidewalls 112, 116. The wall 112 is designated as a front wall, and the wall 116 is designated as a rear wall here for clear description of the packing box 10. The protrusion 150 is formed at an upper portion of the front wall 112. The cover 140 extends from a top edge of the rear wall 116 and forms an insert 142 remote from the rear wall 116. A slot 144 is defined in the insert 142 along a fold between the insert 142 and the cover 140. In assembly, the wings 130 and the cover 140 are folded inward. In detail, the cover 140 contactingly covers the wings 130. The protrusion 150 is inserted into the slot 144 to lock the cover 140, thereby covering the space defined in the packing box 10.

The packing box 10 comprises a base 210 disposed upon the bottom support 120. A first plate 220 extends from the base 210 and is connected to the front wall 112 via a connecting strip 222, which is parallel to the base 210. The strip 222 defines a clearance 224 therein along a fold between the strip 222 and the front wall 112. A second plate 240 extends from the base 210 and is opposite to the first plate 220, with two flanges 242 extending from opposite edges thereof respectively. The flanges 242 are attached to the walls 114 for further positioning the second plate 240 in the packing box 10. Two third-plates 260 extend from the base 210 and are disposed between the first and second plates 220, 240. Each third plate 260 forms a tab 262 near the first plate 220 and defines a gap 264 partially dividing the corresponding plate 260 adjacent to the second plate 240. The tabs 262 are attached to the front wall 112 at locations between the first plate 220 and the bottom support 120. A reinforcing plate 270 is connected to the plate 240 via a connecting ridge 244 parallel to the base 210, for reinforcing the third plate 240. The reinforcing plate 270 defines two gaps 274 therein. The reinforcing plate 270 is inserted into the gaps 264 of the third plates 260 and snaps the third plates 260 in the gaps 274 thereof, respectively. In the embodiment, the space defined in the packing box 10 is divided into two compartments 320, 340 by the second plate 240, and the compartment 320 near the front wall 112 is divided into three compartments 322, 324, 326 by the third plates 260.

In summary, the first, second and third plates 220, 240, 260 are disposed in the space of the packing box 10, and formed by folding a cardboard extension from one or more of the walls, such as the front wall 112 in the exemplary embodiment. The second and third plates 240, 260 function as partitions to separate the space into compartments.

It will be understood that the above particular embodiments and methods are shown and described by way of illustration only. The principles and features of the present invention may be employed in various and numerous embodiments thereof without departing from the scope of the invention as claimed. The above-described embodiments illustrate the scope of the invention but do not restrict the scope of the invention.

What is claimed is:

1. A packing box comprising a plurality of walls, a bottom support, a cover and a plurality of partitions, the walls, the bottom support and the cover cooperatively defining a space for accommodating items to be packed therein, the bottom support being formed with the walls for supporting the items packed in the space, the cover being configured for closing the packing box, the partitions being disposed in the space and formed by folding a cardboard extension from one of the walls, and separating the space into compartments, the partitions comprising a first plate connected to the one of the walls, a second plate parallel to and separated from the first plate, at least one third plate disposed between the first and second plate, and a reinforcing plate connected to the second plate for reinforcing the second plate, the reinforcing plate defines a gap therein, and the at least one third plate defines a gap partially dividing the at least one third plate, and the reinforcing plate is inserted into the gap of the at least one third plate and snaps the at least one third plate in the gap thereof.

2. The packing box as claimed in claim 1, wherein the first plate connected to the wall via a connecting strip.

3. The packing box as claimed in claim 2, wherein the connecting strip defines a clearance along a fold between the connecting strip and the one of the walls, the cover forms an insert inserted in the clearance.

4. The packing box as claimed in claim 3, wherein the insert defines a slot along a fold between the insert and the cover, and the one of the walls forms a protrusion extending in the slot.

5. The packing box as claimed in claim 1, wherein the second plate forms two flanges extending from opposite edges thereof, and the flanges are attached to two of the walls both adjacent to the one of the walls.

6. The packing box as claimed in claim 1, where the at least one third plate forms a tab attached to the one of the walls at a location between the first plate and the bottom support.

7. The packing box as claimed in claim 1, wherein the reinforcing plate is connected to the second plate via a connecting ridge.

8. The packing box as claimed in claim 1, wherein the first plate, second plate and third plate are connected by a base juxtaposed with the bottom support.

9. The packing box as claimed in claim 8, wherein the number of the at least one third plate is two, and the two third plates are parallel connected to two opposite sides between the first and second plates.

10. A packing box comprising a plurality of walls, a bottom support, a cover and a plurality of partitions, the walls, the bottom support and the cover cooperatively defining a space for accommodating items to be packed therein, the bottom support being formed with the walls for supporting the items packed in the space, the cover being configured for closing the packing box, the partitions being disposed in the space and formed by folding a cardboard extension from one of the walls, and separating the space into compartments, the partitions comprising a first plate connected to the one of the walls via a connecting strip, a second plate parallel to and separated from the first plate, a third plate disposed between the first and second plates, and a reinforcing plate connected to the second plate via a connecting ridge, for reinforcing the second plate, the reinforcing plate defines a gap therein, and the third plate defines a gap partially dividing the third plate, and the reinforcing plate is inserted into the gap of the third plate and snaps the third plate in the gap thereof.

11. The packing box as claimed in claim 10, wherein the connecting strip defines a clearance along a fold between the connecting strip and the one of the walls, the cover forms an insert inserted in the clearance.

12. The packing box as claimed in claim 11, wherein the insert defines a slot along a fold between the insert and the cover, and the one of the walls forms a protrusion extending in the slot.

* * * * *